US005348506A

United States Patent [19]

Kawamura et al.

[11] Patent Number: 5,348,506

[45] Date of Patent: Sep. 20, 1994

[54] METHOD OF ASSEMBLING A SHADOW MASK AND AN APPARATUS FOR CARRYING OUT THE SAME

[75] Inventors: Takahiro Kawamura, Kanagawa; Tetsuo Uehira, Chiba, both of Japan

[73] Assignee: Sony Corporation, Tokyo, Japan

[21] Appl. No.: 44,477

[22] Filed: Apr. 9, 1993

[30] Foreign Application Priority Data

Apr. 10, 1992 [JP] Japan ..... 4-091159

[51] Int. Cl.[5] ..... H01J 9/20

[52] U.S. Cl. ..... 445/30; 445/68

[58] Field of Search ..... 445/30, 68

[56] References Cited

U.S. PATENT DOCUMENTS

| | | | |
|---|---|---|---|
| 3,537,159 | 11/1970 | Gartner et al. | 445/68 |
| 3,537,161 | 11/1970 | Kautz | 445/30 |
| 4,130,919 | 12/1978 | Oyama | 445/30 |
| 5,167,558 | 12/1992 | Duchek et al. | 445/30 |

*Primary Examiner*—P. Austin Bradley
*Assistant Examiner*—Jeffrey T. Knapp
*Attorney, Agent, or Firm*—Hill, Steadman & Simpson

[57] ABSTRACT

A shadow mask assembling apparatus assembles an election beam selection mask for a color cathode ray tube by welding a mask sheet to a frame. The electron beam selection mask assembling apparatus comprises: a bed; a frame support for supporting the frame on the bed with the mask sheet support surfaces of the support members facing upward; a frame positioner for positioning the frame on the frame support; a mask sheet positioner for positioning the mask sheet on the support members of the frame; a fixer for fixing the mask sheet in place on the mask sheet support surfaces of the support members of the frame; a mask sheet support for supporting the central portion and peripheral portions extending beyond the support members of the frame of the mask sheet; and an attaching structure for attaching the mask sheet to the mask sheet support surfaces of the support members of the frame.

14 Claims, 6 Drawing Sheets

METHOD OF ASSEMBLING A SHADOW MASK AND AN APPARATUS FOR CARRYING OUT THE SAME

BACKGROUND OF THE INVENTION

1. Field of the Invention

The present invention relates to a method of assembling a shadow mask and an apparatus for carrying out the same and, more particularly, to a method of welding a mask sheet of a small thickness on the order of 50 μm to a frame, and an apparatus for carrying out the same.

2. Description of the Prior Art

A color picture tube, such as a color CRT, is provided with a shadow mask behind a three-color phosphor film formed over the inner surface of its faceplate, to display color pictures in a satisfactory picture quality.

A color picture tube of the Trinitron® system is provided with an aperture grille, i.e., a shadow mask, formed by attaching a mask sheet under appropriate tension to a steel frame. The mask sheet is formed by forming vertical slits in a thin soft steel sheet.

Referring to FIGS. 5 and 6, when assembling this aperture grille, a frame 4 having A-members 2 and B-members 3, is set on a frame support 11 placed on a base 20. The frame 4 is located at a specified position by a frame locating device 1 having an A-member locating jig 5 and B-member locating rollers 6. Then the A-members 2 are drawn towards each other with turnbuckles. Then, a thin mask sheet 7 is placed on the A-members 2 so that locating pins 9 of the assembling machine are received respectively in reference holes formed therein. Then, the locating pins 9 are moved slightly outward, the upper and lower edges of the mask sheet 7 are gripped with grippers, and then the frame 4 is raised slightly to tighten the mask sheet 7 so that the mask sheet 7 is pressed in close contact with the frame 4. Subsequently, the mask sheet 7 is welded to the A-members 2 by roll spot welding or the like.

If the mask sheet 7 has a thickness on the order of 150 μm, the mask sheet 7 has a sufficient stiffness to maintain its shape and the central slit portion of the mask sheet 7 will not sag when the mask sheet 7 is placed on the frame 4 located at the specified position. However, if the mask sheet 7 has a thickness on the order of 50 μm, which is one-third the thickness of the ordinary mask sheet, to construct a light weight aperture grille, the slit central portion 7*a* of the mask sheet 7 sags between the A-members 2 of the frame 4 and, consequently, the mask sheet 7 cannot be properly set on the frame 4 and it is difficult to weld the mask sheet 7 to the A-members 2 of the frame 4 by the ordinary welding process. Such a difficulty due to the sagging of the slit central portion 7*a* of the mask sheet 7 is significant when the mask sheet 7 is a large one for a color picture tube of 30 in. or greater.

SUMMARY OF THE INVENTION

Accordingly, it is an object of the present invention to provide a method of assembling a shadow mask, capable of satisfactorily attaching a thin mask sheet of a thickness on the order of 50 μm to a frame by welding.

Another object of the present invention is to provide an apparatus for assembling a shadow mask, capable of satisfactorily attaching a thin mask sheet of a thickness on the order of 50 μm to a frame by welding.

In a first aspect of the present invention, a method of assembling a shadow mask comprises the steps of placing a mask sheet formed by processing a thin metal sheet on a pair of parallel support members having a specified curvature, and welding the mask sheet to the pair of parallel support members to form a shadow mask. A curved mask sheet support sheet having a curvature substantially equal to that of the pair of parallel support members is disposed with its curved upper surface substantially on the level of the upper surfaces of the pair of parallel support members. Then the mask sheet is placed on the pair of curved support members.

In a second aspect of the present invention, an apparatus for assembling a shadow mask by welding a mask sheet to a pair of parallel support members of a frame comprises a frame positioning mechanism for positioning the frame, a mask sheet positioning means for positioning the mask sheet on the frame, a mask sheet support plate for supporting the mask sheet positioned on the frame, and a welding unit for welding the mask sheet positioned on the frame to the pair of parallel support members. The upper surfaces of the pair of parallel support members are upward convex, and the upper surface of the mask sheet support plate is upward convex and has a curvature equal to that of the upper surfaces of the pair of parallel support members.

The mask sheet support plate supports the mask sheet positioned on the pair of parallel support members in place steadily to prevent the sagging of the central portion of the mask sheet placed on the pair of parallel support members. Therefore, the mask sheet will not be dislocated from a correct position on the pair of parallel support members and the mask sheet can be easily and correctly welded to the pair of parallel support members.

Thus, the present invention enables a very thin mask sheet having a thickness on the order of 50 μm to be welded easily to the frame to construct a lightweight shadow mask, which contributes to forming a lightweight color picture tube and to the reduction of the material cost of the shadow mask.

Furthermore, since the thickness of slits of the shadow mask provided with such a very thin mask sheet is smaller than that of the slits of the mask sheet of the conventional shadow mask, the unstable reflection of electron beams at the slits is reduced remarkably to improve the three-color phosphor film irradiating efficiency of electron beams.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
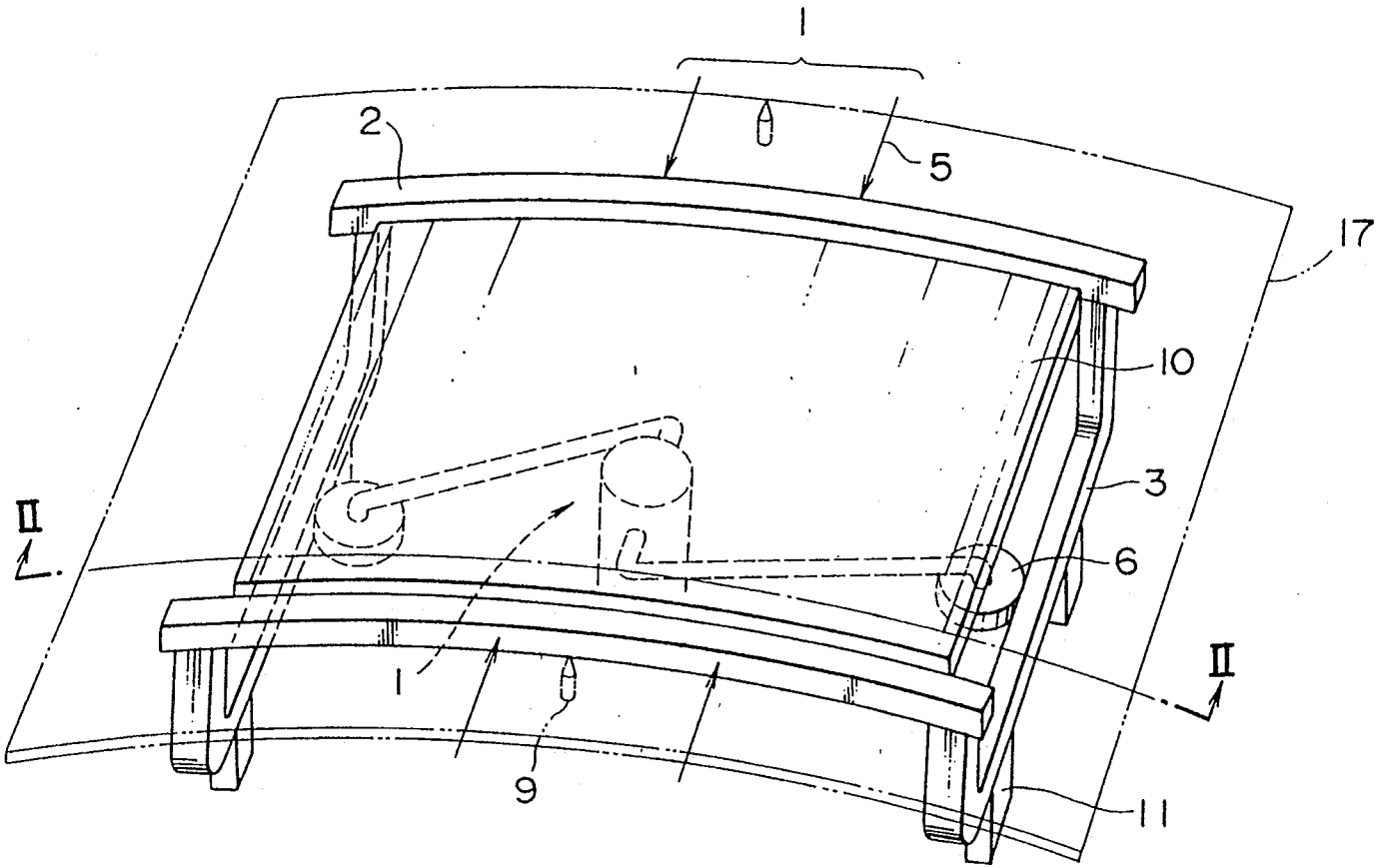
FIG. 1 is a schematic perspective view of a shadow mask assembling apparatus in a first embodiment according to the present invention.
Figure 2:
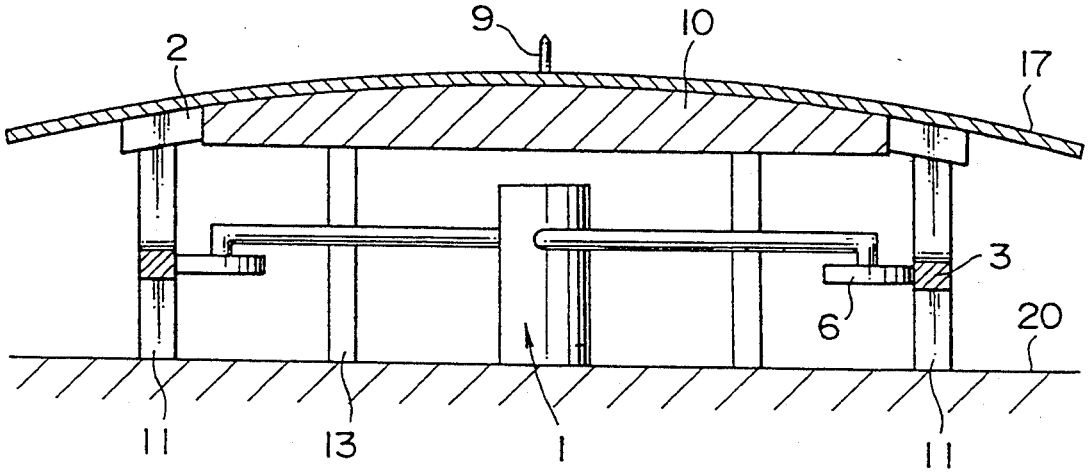
FIG. 2 is a sectional view taken on line A—A in FIG. 1.

First Embodiment (FIGS. 1 and 2)

Referring to FIG. 1, a shadow mask assembling apparatus in a first embodiment according to the present invention comprises a base 20, a frame support 11 placed on the base 20 to support a mask sheet 17, a frame positioning device 1 set on the base 20 to position the frame, a mask sheet support plate 10 disposed in a space demarcated by the frame support 11 to support the central portion of the mask sheet 17, and a welding unit, not shown, for welding the mask sheet 17 to the frame.

The frame for holding the mask sheet 17 has a pair of parallel A-members 2 and a pair of parallel B-members 3 extending perpendicularly to the A-members 2. The upper surfaces of the pair of parallel A-members 2 are curved in an upward convex shape. The upper surface of the mask sheet support plate 10 is curved in an upward convex shape with a curvature equal to that of the pair of parallel A-members 2 of the frame.

The frame positioning device 1 comprises a positioning jig 5 and positioning rollers 6. When positioning the frame on the frame support 11, one of the A-members 2 is brought into abutment with the positioning jig 5, and the positioning rollers 6 are brought into contact with the B-members 3. The mask sheet support plate 10 is so disposed that the mask sheet support plate 10 will not interfere with the components of the frame positioning device 1. The positioning rollers 6 are moved horizontally by a cylinder actuator or the like, and the mask sheet support plate 10 is moved vertically by a cylinder actuator or the like.

A procedure of assembling the shadow mask, for example, for a 29 in. color picture tube, by welding the mask sheet 17 to the A-members 2 of the frame on the shadow mask assembling apparatus will be described hereinafter.

The frame is placed on the frame support 11 with the convex surfaces of the A-members 2 facing upward and the B-members 3 seated on the frame support 11. The frame is positioned by the frame positioning device 1, the A-members 2 are braced by the turnbuckles, the mask sheet support plate 10 is positioned so that the upward convex upper surface thereof is substantially at the level of the upward convex surfaces of the A-members 2 in order that the plurality of tapes forming the slits of the mask sheet 17 are arranged properly, and then the mask sheet 17 for a 29 in. color picture tube, formed by processing a 50 μm thick soft steel sheet, is placed on the A-members 2 of the frame. The peripheral portions of the mask sheet 17 are seated on auxiliary support members 12 (FIG. 3) having upper surfaces coinciding with the extensions of the upward convex surface of the mask sheet support plate 10 to support the peripheral portions of the mask sheet 17 so that the mask sheet 17 may not warp. Then, positioning pins 9 are inserted in reference holes formed in the mask sheet 17. Then the positioning pins 9 are moved slightly outward to position and brace the mask sheet 17 on the frame. Then, the auxiliary support members 12 are retracted into the mask sheet support plate 10, and the mask sheet support plate 10 is lowered to separate the same from the mask sheet 17. Then, the frame is raised slightly to tighten the mask sheet 17, the frame is positioned at a specified position, and then the mask sheet 17 is welded to the A-members 2 of the frame. After the mask sheet 17 has been perfectly welded to the A-members 2, the turnbuckles are removed from the A-members 2.

The mask sheet support plate 10 has a curvature substantially equal to that of the convex surfaces of the A-members 2 in a state where the mask sheet 17 has been welded to the A-members 2, a thickness of about 50 mm, a length smaller than that of the frame by about 30 to about 50 mm, and a width smaller than that of the frame by about 30 to 50 mm. As shown in FIG. 2, the mask sheet support plate 10 is supported on a vertically movable column 13. The shadow mask assembling apparatus is capable of assembling various shadow masks other than that provided with the mask sheet of 50 μm in thickness for the 29 in. color picture tube, such as those provided with a mask sheet of 100 μm or 150 μm in thickness for large color picture tubes having a screen size of 30 in. or greater.

Figure 3:
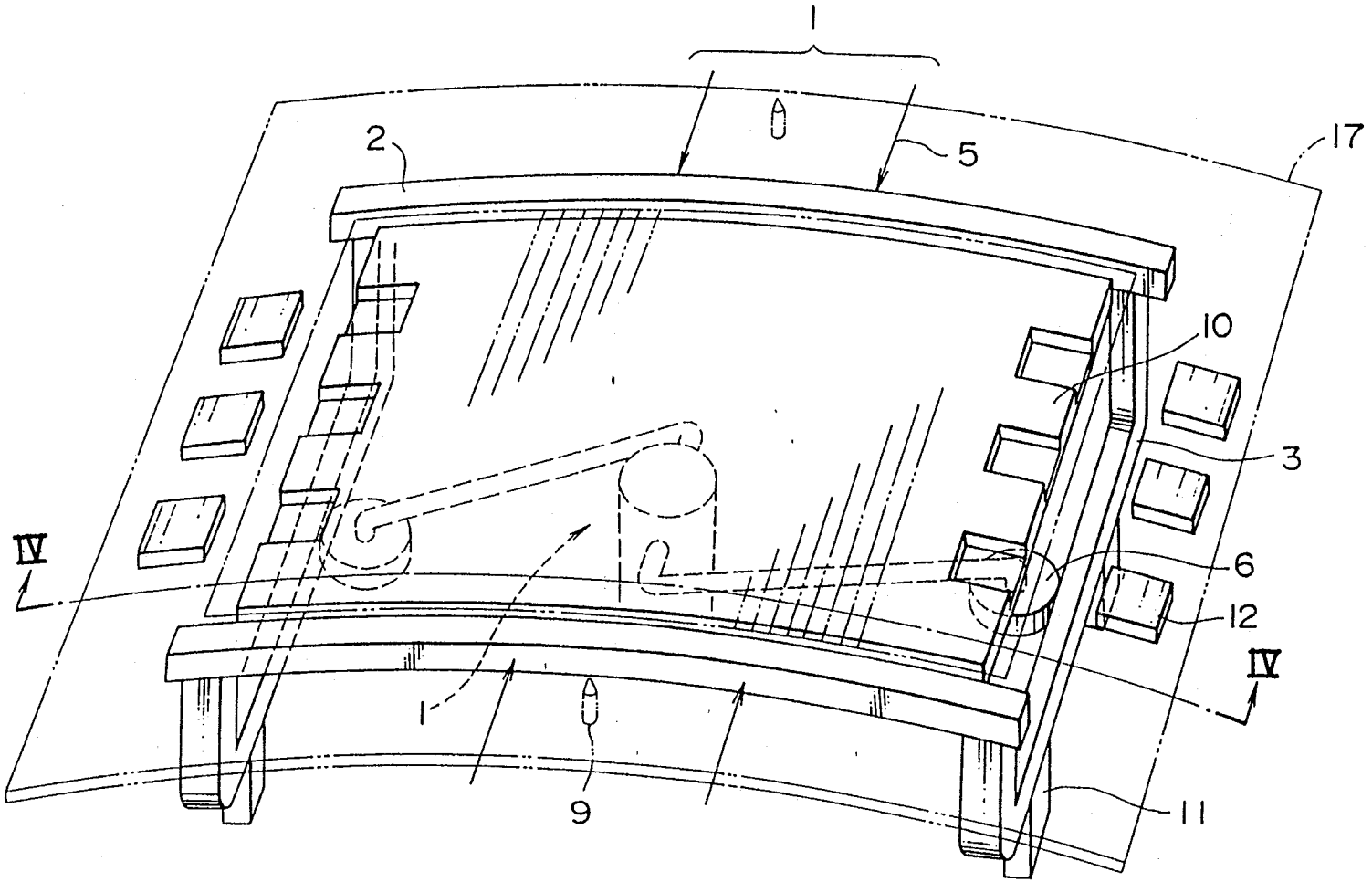
FIG. 3 is a schematic perspective view of a shadow mask assembling apparatus in a second embodiment according to the present invention.
Figure 4:
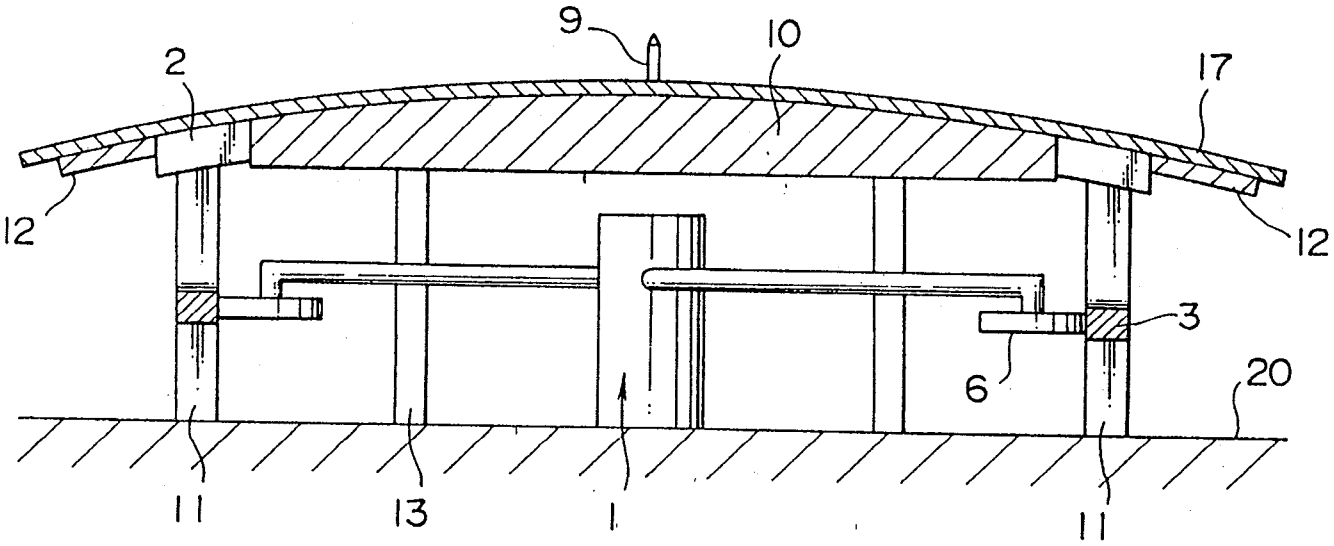
FIG. 4 is a sectional view taken on line A—A in FIG. 3.
Figure 5:
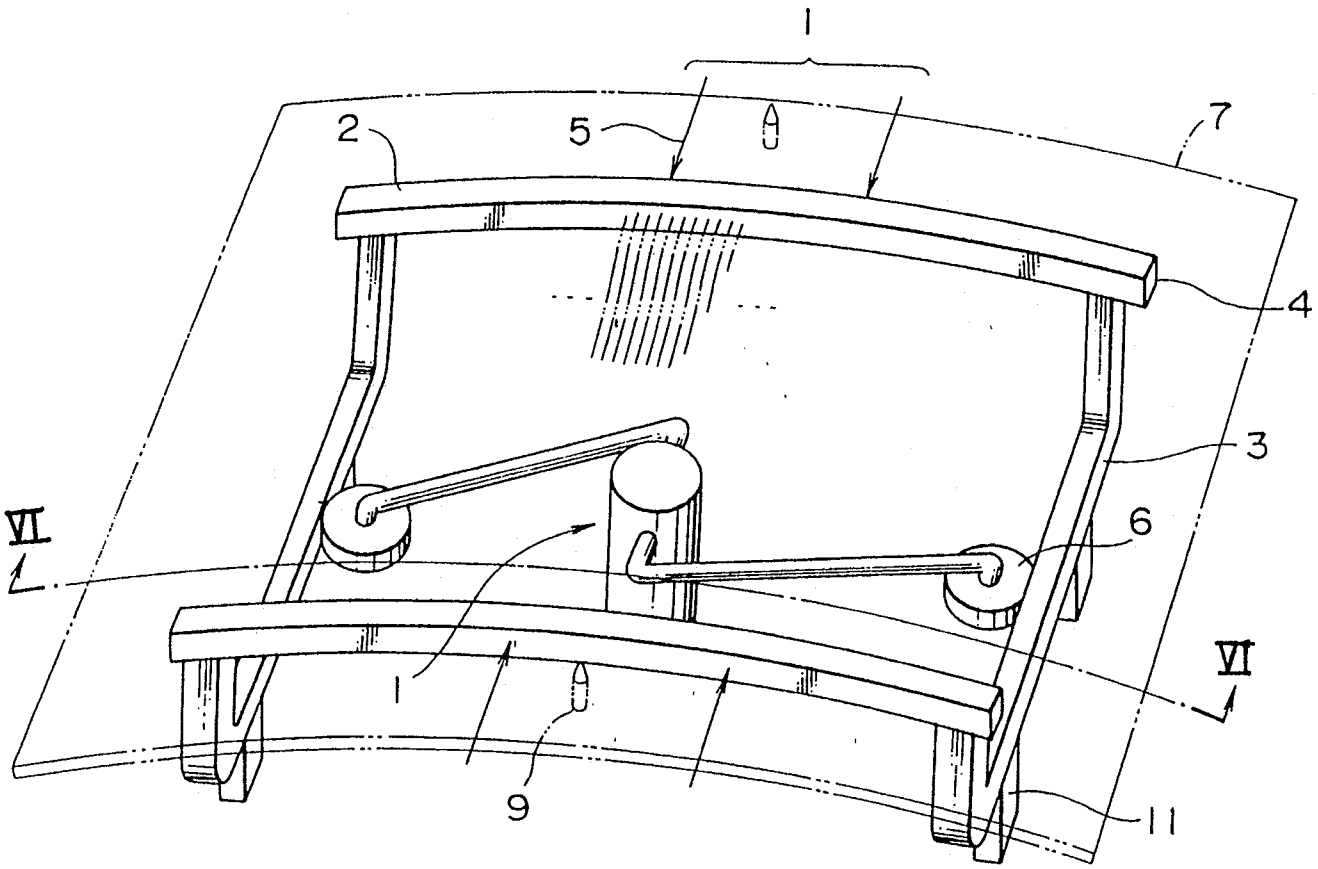
FIG. 5 PRIOR ART
FIG. 5 is a schematic perspective view of a conventional shadow mask assembling apparatus.
Figure 6:
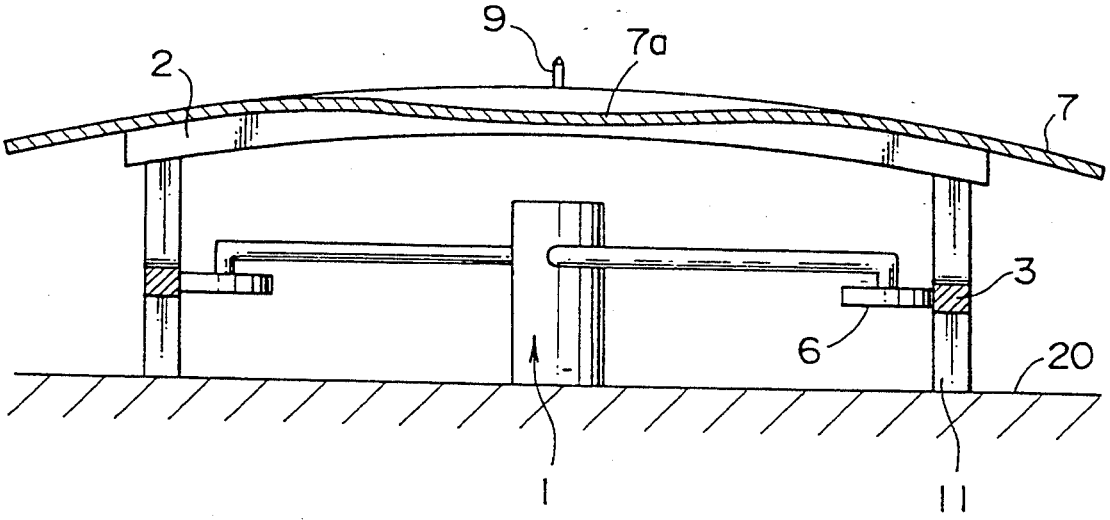
FIG. 6 PRIOR ART
FIG. 6 is a sectional view taken on line B—B in FIG. 5.

Second Embodiment (FIGS. 3 and 4)

A shadow mask assembling apparatus in a second embodiment according to the present invention is substantially the same in construction as the shadow mask assembling apparatus in the first embodiment, except that the shadow mask assembling apparatus in the second embodiment is provided with a mask sheet support plate different from the mask sheet support plate 10 of the first embodiment, and hence only the mask sheet support plate employed in the second embodiment will be described.

Referring to FIGS. 3 and 4, the shadow mask assembling apparatus is provided with a mask sheet support plate 10 for supporting the central portion of the mask sheet 17 provided with slits, having recesses formed in the opposite side edges thereof, and auxiliary mask sheet support members 12 for supporting the peripheral portions of the mask sheet 17, having upper surfaces coinciding with the extensions of the upper surface of the mask sheet support plate 10 when positioned respectively at working positions. The auxiliary mask sheet support members 12 can be fitted respectively in the recesses formed in the side edges of the mask sheet support plate 10 when not in use and can be moved out of the recesses to the working positions to support the peripheral portions of the mask sheet 17.

The mask sheet 17 is welded to the frame and the peripheral portions of the mask sheet 17 extending beyond the frame may be trimmed by pulling, or by laser beam trimming.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A method of assembling an electron beam selection mask formed of a mask sheet for a color cathode ray tube, comprising the steps of:

providing a frame formed by a pair of spaced apart parallel support members each having an upper curved mask sheet support surface, said parallel support members each having a longitudinal extent along the mask sheet;

providing a mask sheet having parallel slits;

providing a mask sheet support plate extending from the one parallel support member to the opposite parallel support member and which fits between the two support members, said mask sheet support plate having an upper surface which is curved in a same curvature as said upper curved mask sheet support surfaces;

setting the frame with the mask sheet support surfaces facing upward and positioning the frame;

positioning the mask sheet support plate between the two parallel support members so that said upper curved surface of said mask sheet support plate coincides with the parallel support member mask sheet upper support surfaces;

placing the mask sheet on the curved upper surfaces of the parallel support members and plate;

fixedly positioning the mask sheet on the frame; and attaching the mask sheet to the support members.

2. A method according to claim 1 including the step of attaching the mask sheet to the support members of the frame by welding.

3. A method according to claim 1 including the further step of separating the plate from the mask sheet after the mask sheet has been attached to the frame parallel support members.

4. A method according to claim 1 wherein the mask sheet is attached to the mask sheet support surfaces of the parallel support members.

5. A method according to claim 1 including the step of providing a plurality of auxiliary support members for supporting peripheral portions of the mask sheet.

6. A method according to claim 5 including the step of disposing symmetrically the plurality of auxiliary support members on opposite sides of the mask sheet support plate.

7. A method according to claim 6 including the step of providing cut-out regions in said plate for receiving said auxiliary support members when the auxiliary support members are no longer needed for supporting the peripheral portions of the mask sheet.

8. An apparatus for assembling an electron beam selection mask formed of a mask sheet, comprising:

a frame comprising a pair of parallel support members having respective curved upper mask sheet support surfaces, and a connecting structure connecting the parallel support members together in spaced apart relationship, said parallel support members each having a longitudinal extent along the mask sheet;

a bed;

the frame supported on the bed;

a frame positioner for positioning the frame relative to the bed;

a mask sheet positioner for positioning the mask sheet on the spaced apart parallel support members of the frame;

fixing means for fixing the mask sheet in place on the mask sheet support surfaces of the parallel support members;

a mask sheet support plate for supporting a central portion of the mask sheet when it is resting on the mask sheet upper support surfaces, said mask sheet support plate extending from one parallel support member to the other parallel support member and having a curved upper surface corresponding to a curvature of the curved mask sheet support surfaces of the parallel support members; and said mask sheet support plate being dimensioned to be received between the parallel support members.

9. An apparatus according to claim 8 wherein the support plate is positioned such that its upper curved surface is aligned with and coincides with the upper curved surface of the two parallel support members.

10. An apparatus according to claim 8 wherein the screen is welded to the parallel support members.

11. An apparatus according to claim 8 wherein auxiliary support members are provided as an extension of said support plate at opposite sides thereof for holding peripheral portions of the mask sheet in position.

12. An apparatus according to claim 11 wherein the support plate has pockets for receiving the auxiliary support members when they are not in use.

13. An apparatus according to claim 8 wherein two parallel connecting members are provided to hold the parallel support members in spaced-apart parallel position.

14. An apparatus according to claim 13 wherein frame supports are provided extending from each of said connecting members for supporting the frame on the bed.

* * * * *